United States Patent [19]

Perkins

[11] Patent Number: 4,484,627

[45] Date of Patent: Nov. 27, 1984

[54] WELL COMPLETION FOR ELECTRICAL POWER TRANSMISSION

[75] Inventor: Thomas K. Perkins, Dallas, Tex.

[73] Assignee: Atlantic Richfield Company, Los Angeles, Calif.

[21] Appl. No.: 509,839

[22] Filed: Jun. 30, 1983

[51] Int. Cl.[3] ..... E21B 36/04; E21B 43/24

[52] U.S. Cl. ..... 166/248; 166/65 R

[58] Field of Search ..... 166/248, 65 R, 65 M, 166/66, 60, DIG. 1, 242; 219/277, 278

[56] References Cited

U.S. PATENT DOCUMENTS

| | | | |
|---|---|---|---|
| 3,141,504 | 7/1964 | Sarapuu | 166/248 |
| 3,547,193 | 12/1970 | Gill | 166/248 |
| 3,642,066 | 2/1972 | Gill | 166/248 |
| 3,766,985 | 10/1973 | Willhite | 166/DIG. 1 |
| 3,946,809 | 3/1976 | Hagedorn | 166/248 |
| 4,412,585 | 11/1983 | Bouck | 166/248 |

*Primary Examiner*—George A. Suchfield
*Assistant Examiner*—Michael Starinsky
*Attorney, Agent, or Firm*—M. David Folzenlogen

[57] ABSTRACT

There is provided a well completion for electrical alternating current power transmission that minimizes power losses and related corrosion problems. Casing is used both as the electrode and conductor. Most of the conductor portion is made of nonmagnetic metal, for example aluminum, and is electrically insulated both exteriorly and interiorly. The insulation extends below the point where the nonmagnetic metal ends. Tubing is used to produce or inject fluids. The upper end of the conductor-electrode may be surrounded by a nonmagnetic surface string which is also electrically insulated.

18 Claims, 1 Drawing Figure

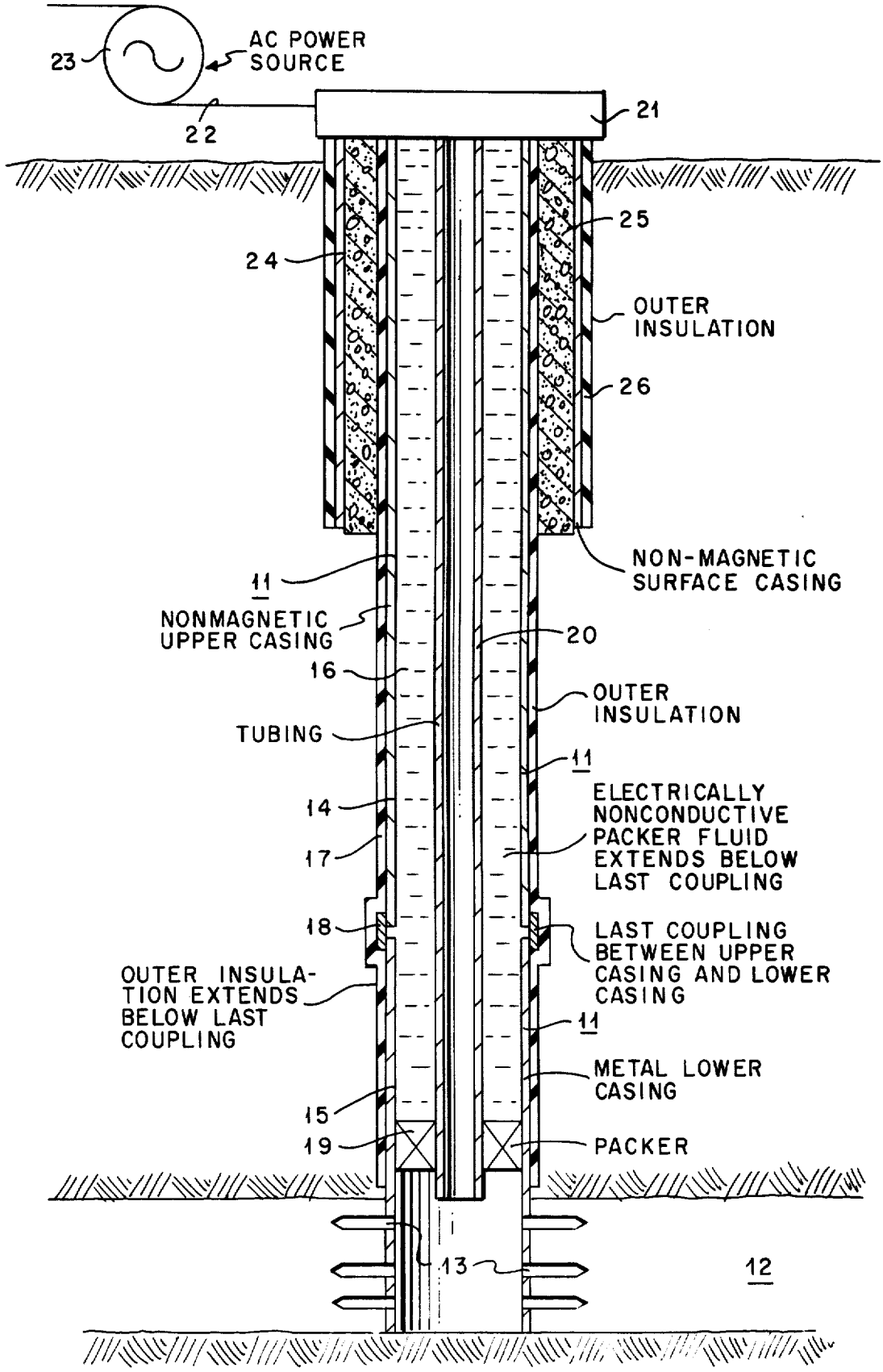
AC POWER SOURCE
23
22
21
25
24
OUTER INSULATION
26
NON-MAGNETIC SURFACE CASING
11
NONMAGNETIC UPPER CASING
20
16
OUTER INSULATION
TUBING
11
14
ELECTRICALLY NONCONDUCTIVE PACKER FLUID EXTENDS BELOW LAST COUPLING
17
18
LAST COUPLING BETWEEN UPPER CASING AND LOWER CASING
OUTER INSULATION EXTENDS BELOW LAST COUPLING
11
METAL LOWER CASING
15
19
PACKER
13
12

WELL COMPLETION FOR ELECTRICAL POWER TRANSMISSION

BACKGROUND OF THE INVENTION

This invention pertains to an improved well completion for electrical power transmission to a subsurface formation. More particularly, power transmission efficiency is increased using a lower part of the casing as the electrode and insulated nonmagnetic metal upper casing as the primary conductor.

Large deposits of viscous hydrocarbonaceous substances are known to exist in subterranean formations such as for example, the Ugnu formation in Alaska. Many techniques have been proposed for producing tar sands and viscous oils. Relatively recently it has been proposed, for example, in U.S. Pat. Nos. 3,642,066; 3,874,450; 3,848,671; 3,948,319; 3,958,636; 4,010,799 and 4,084,637, to use electrical current to add heat to a subsurface pay zone containing tar sands or viscous oil to render the viscous hydrocarbon more flowable. Two electrodes are connected to an electrical power source and are positioned at spaced apart points in contact with the earth. Currents up to 1200 amperes are passed between the electrodes. The effectiveness of the process, therefore, depends on power transmission efficiencies. It is the primary purpose of this invention to provide an electrical power transmission well completion system of reduced impedence and power losses.

SUMMARY OF THE INVENTION

In accordance with this invention, power transmission efficiency to a subsurface electrode from an alternating current power source is maximized and related corrosion problems are minimized. A string of casing is used as the electrode and conductor. The part of the casing that is not used as the electrode is electrically insulated both externally and internally to isolate current flow to the electrode area and to prevent corrosion of the interior and exterior part of the casing that is most likely to be corroded by undesirable current flows. The upper part of the casing is made of a nonmagnetic metal, for example, aluminum, to reduce magnetic hysteresis power losses. A tubing string is placed inside the casing. The tubing is used to either produce subsurface formation fluids or to inject fluids into a subsurface formation. A nonconducting liquid may be placed between the casing and tubing to insulate the interior surface of the casing. The upper end of the conductor-electrode casing may be surrounded in typical fashion by a surface casing string. The surface string is also made of nonmagnetic metal and the exterior of the surface string is also electrically insulated. The interior of the surface string may be filled with cement.

BRIEF DESCRIPTION OF THE DRAWING

The drawing is a side elevational view, partly schematic and partly in section, illustrating a simplified embodiment of the well completion of this invention.

DESCRIPTION OF PREFERRED EMBODIMENTS

In the drawing, there is illustrated a well completion system for transmitting alternating current power to a subsurface formation. The power is used to apply heat to a hydrocarbonaceous material to stimulate production of oil fluids from a pay zone. The power may be applied at any desirable point in, above or below the pay zone. The power transmission well may be used as an injection well, or a producing well, or both.

More specifically, metal casing string 11 extends from near the surface of the earth downwardly at least to subsurface formation 12 where an electrode is to be located so that alternating current of up to 1200 amperes may be passed through the formation. Casing 11 may extend beyond formation 12. The casing is shown perforated at 13 in formation 12.

In the drawing, the part of the casing electrically exposed to and in contact with the formation is used as the electrode and the part above the formation is used as an electric conductor.

Casing 11 is comprised of casing sections and is divided into upper casing portion 14 and lower casing portion 15 which includes the part of the casing that acts as the electrode. In order to reduce the overall impedance of the transmission system and reduce magnetic hysteresis losses, upper casing portion 14 is comprised to a nonmagnetic metal, such as for example, stainless steel or aluminum. Aluminum is preferred because of its high conductivity and availability. But aluminum is very susceptible to corrosion and metal loss due to current leaving the casing. Corrosion and premature loss of power to the overburden above formation 12 are effectively prevented by electrically insulating the upper casing portion with inner electrical insulation 16 and outer electrical insulation 17. It is important that the electrical insulation covering the exterior and interior surfaces of upper casing portion 14 extend downward below lowest or last coupling 18 which connects the upper casing portion to the lower casing portion and into a part of lower casing portion 15. The outer electrical insulation on the exterior surface of the upper casing portion may be comprised of coatings, pipe wrapping, extruded plastic, heat shrinkable sleeves, or other similar insulating or nonconductive corrosion protection materials. Some of the insulation may be pre-applied. The inner electrical insulation may be comprised of a pipe liner, an extruded liner, coatings or other similar internal insulating or nonconductive corrosion protection materials; but the preferred inner insulation is shown as packer 19 and nonconductive packer fluid 16 which is placed in the annulus above the packer between casing 11 and tubing 20. Packer fluid may be any standard nonconductive or oil base fluid or thixotropic substance. Tubing 20 extends downward from the surface of the earth inside casing 11 through at least a part of lower casing portion 15. The tubing may extend beyond the casing. The tubing is adapted to be used for injection, or production, or both between the surface and a predetermined subsurface point.

Casing 11 is shown connected to typical metal christmas tree 21 represented schematically. The christmas tree is shown electrically connected via conductor 22 to alternating current power source 23. Power source 23 is capable of generating voltages up to several thousand volts. Typically, a well includes surface casing string 24 which extends through fresh water zones to a predetermined point and is sealed in place with cement 25. Casing 11 extends through and is surrounded by surface casing 24. If this surface casing were made of ordinary steel casing, it would cause hysteresis losses in upper casing portion 14. Accordingly, in this invention, the surface casing string is comprised of a nonmagnetic metal, preferably aluminum. The outer or exterior surface of this surface casing is insulated with outer electrical insulation 26. Cement 25 will normally act as an inner insulation for the surface casing string, but other insulating systems, for example, a packer and nonconducting packer fluid, may be used. The electrical insulation systems previously mentioned for upper casing portion 14 may be used.

In application, a borehole large enough for outer surface casing string 24 is first drilled to a predetermined depth and the surface casing is lowered down into the earth and set at a predetermined point. The casing is made of nonmagnetic metal. As it is lowered into the earth, most of the exposed outer surface of the casing is covered with electrical insulation. Some of the outer and inner surface of the casing may be preinsulated. If the surface casing is to be cemented in place, it will contain a cementing shoe or tool.

After the surface casing has been installed, a borehole is drilled for metal casing 11 and the casing is lowered downward into the earth. The part of casing 11 that is to be used as the electrode is lowered exposed so that its outer surface can contact the formation opposite the predetermined point where the electrode will be used to apply heat to a subsurface formation. Thereafter, as the lower part of casing 11 is lowered, most of the exposed exterior surface of an upper portion of lower casing string 15 is covered with electrical insulation 17. Part of the casing may be pre-insulated.

When the last part of the desired amount of lower casing string or portion 15 is ready to be lowered, it is connected via coupling 18 to nonmagnetic upper casing string or portion 14. Upper casing is added until the electrode part of the lower casing string is positioned opposite the desired point in formation 12. As the upper casing is lowered into the earth, most of the exposed exterior surface of the upper casing string is covered with electrical insulation 17. Part of the nonmagnetic casing may be pre-insulated.

Thereafter, tubing string 20 with packer 19 is lowered downward from the surface of the earth into and through upper casing string 14 and into lower casing string 15. The packer is set in typical fashion at a point inside the lower casing string below the lowest point of upper casing string. This is important to the well completion system of this invention. After the packer is set, electrically nonconductive liquid is added to the annulus between the tubing and casing above the packer. This electrically insulates the interior surface of the desired portion of casing 11.

After the transmission well has been so completed, alternating current power source 23 is electrically connected via conductor 22 and christmas tree 21 to casing 11.

Reasonable variations and modifications are possible within the scope of this disclosure without departing from the spirit and scope of this invention.

What is claimed is:

1. A well completion for electrical power transmission to subsurface electrode for applying heat to a subsurface formation comprising:

(a) a metal first casing string extending from near the surface of the earth downward at least to a predetermined point where an electrode is to be located, said first casing string being divided into an upper casing portion and a lower casing portion, said upper casing portion being a nonmagnetic metal;

(b) first outer electrical insulation on the exterior surface of said upper casing portion and a part of said lower casing portion;

(c) first inner electrical insulation covering most of the interior surface of said upper casing portion and a part of said lower casing portion;

(d) an inner tubing string extending from surface of the earth downward inside said first casing string through at least a part of said lower casing portion, said tubing string being adapted to conduct fluids between the surface and a predetermined subsurface point; and (e) an alternating current power source electrically connected to said first casing string.

2. The well completion of claim 1 wherein said upper casing portion is comprised of aluminum.

3. The well completion of claim 1 wherein a packer means is located below said upper casing portion and said inner electrical insulation is an electrically nonconducting packer fluid in the annulus between said tubing string and the portion of said casing string above said packer means.

4. The well completion of claim 3 wherein the upper casing portion is comprised of aluminum.

5. The well completion of claim 1 wherein a second casing string extends from near the surface of the earth downward at least to predetermined subsurface point, said second casing string surrounding said first inner string, first outer electrical insulation on the exterior surface of said second casing string and second inner insulation covering most of the interior surface of said second casing string.

6. The well completion of claim 5 wherein said upper casing portion is comprised of aluminum.

7. The well completion of claim 5 wherein a packer means is located below said upper casing portion and said inner electrical insulation is an electrically nonconducting packer fluid in the annulus between said tubing string and the portion of said casing string above said packer means.

8. The well completion of claim 7 wherein said upper casing portion is comprised of aluminum.

9. The well completion of claim 5 wherein said second inner insulation is comprised of cement.

10. The completion of claim 9 wherein said upper casing portion is comprised of aluminum.

11. The well completion of claim 9 wherein a packer means is located below said upper casing portion and said inner electrical insulation is an electrically nonconducting packer fluid in the annulus between said tubing string and the portion of casing string above said packer means.

12. The well completion of claim 11 wherein said upper casing portion is comprised of aluminum.

13. A method for completing a well for transmitting electrical power into a subsurface area comprising:

(a) lowering a metal lower casing string downward into the earth;

(b) connecting said lower casing string to a nonmagnetic metal upper casing string and lowering said upper casing string and said lower casing string downward into the earth at least to a first point where an electrode is to be located;

(c) covering most of the exposed exterior surface of an upper portion of said lower casing string with an electrical insulation as said lower casing string is being lowered into the earth;

(d) covering most of the exposed exterior surface of said upper casing string with electrical insulation as said upper string is lowered into the earth;

(e) lowering a tubing string with a packer downward from the surface of the earth into and through said upper casing string and into said lower casing string;

(f) setting said packer at a point inside said lower casing string below the lowest point of said upper casing string;

(g) adding an electrically nonconductive liquid to the annulus between said tubing and said casing above said packer; and (h) connecting an alternating current power source to said upper casing string.

14. In the method of claim 13 wherein said upper casing string is comprised of aluminum.

15. In the method of claim 13 wherein before step (a) a nonmagnetic metal outer surface casing string is lowered down into the earth to a predetermined point and most of the exposed exterior surface of said surface casing string is covered with electrical insulation as said surface casing string is lowered into the earth.

16. In the method of claim 15 wherein said upper casing string is comprised of aluminum.

17. In the method of claim 15 wherein cement is placed inside said surface casing string.

18. In the method of claim 17 wherein said upper casing string is comprised of aluminum.

* * * * *